United States Patent [19]

Monson

[11] 4,339,840

[45] * Jul. 20, 1982

[54] ROTARY FLOORING SURFACE TREATING DEVICE

[76] Inventor: Clifford L. Monson, #714, 411 Hobron La., Honolulu, Hi. 96815

[ * ] Notice: The portion of the term of this patent subsequent to Jun. 8, 1999, has been disclaimed.

[21] Appl. No.: 251,118

[22] Filed: Apr. 6, 1981

Related U.S. Application Data

[63] Continuation-in-part of Ser. No. 89,486, Oct. 30, 1979, Pat. No. 4,264,999, and Ser. No. 166,396, Jul. 7, 1980.

[51] Int. Cl.[3] ..... A47L 11/34

[52] U.S. Cl. ..... 15/321; 15/320

[58] Field of Search ..... 15/320, 321, 385

[56] References Cited

U.S. PATENT DOCUMENTS

| | | | |
|---|---|---|---|
| 3,375,540 | 4/1968 | Hyde | 15/320 |
| 3,619,848 | 11/1971 | Salzmann | 15/320 |
| 3,624,668 | 11/1971 | Krause | 15/321 X |
| 4,000,538 | 1/1977 | Tissier | 15/320 |
| 4,182,001 | 1/1980 | Krause | 15/320 |

*Primary Examiner*—Chris K. Moore

*Attorney, Agent, or Firm*—Watson, Cole, Grindle & Watson

[57] ABSTRACT

A flooring surface treating device which can be used to spray a liquid cleaning solution onto a rug and then vacuum remove it, or else spray a wax-removing solution onto a wooden or tile floor surface and then vacuum remove it, etc., includes a lower carriage unit which is mounted to be movable on and over the surface to be treated and an adjustably interconnected upper handle unit for the operator's gripping. The lower carriage unit includes a shroud and a drive motor, the shroud generally enclosing and the drive motor rotating a wand which includes multiple radially-extending vacuum ducts and adjacent discharge pipes (with spray nozzles). The vacuum ducts are continuously connectable to a vacuum source and the discharge pipes are continuously connectable to a source of liquid treating solution.

10 Claims, 12 Drawing Figures

FIG. 1
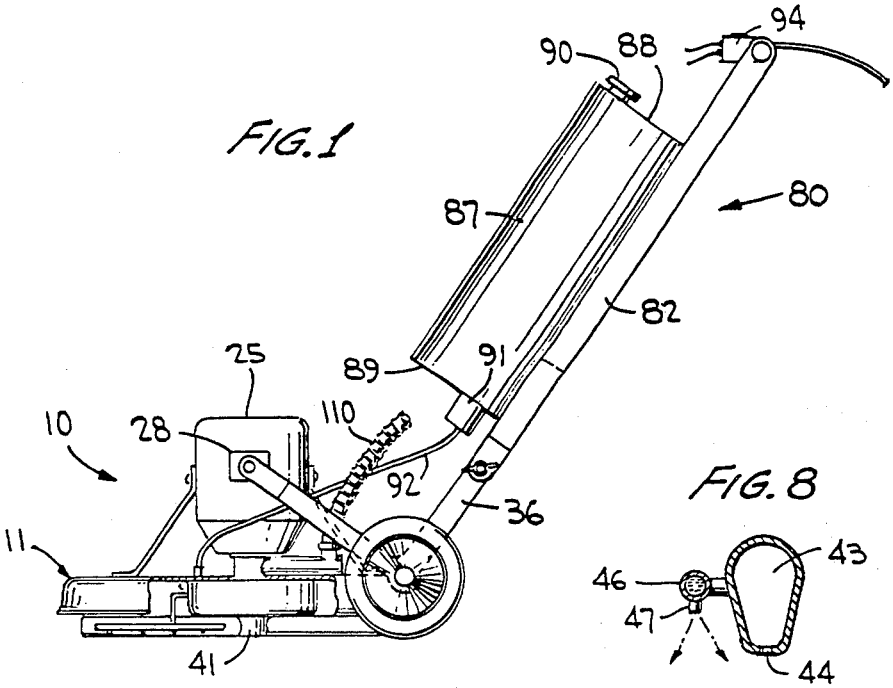
FIG. 8
FIG. 2
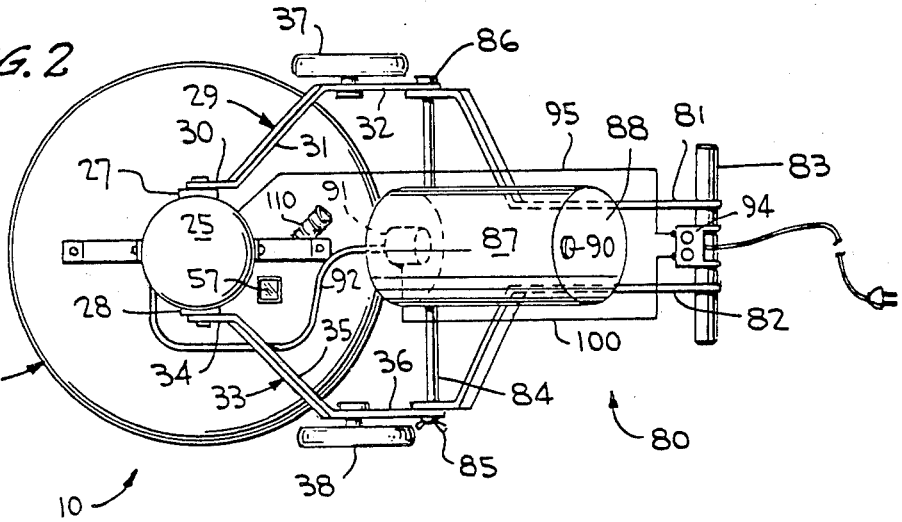

ROTARY FLOORING SURFACE TREATING DEVICE

CROSS-REFERENCE TO RELATED APPLICATION

The present application is a continuation-in-part application of both application Ser. No. 089,486, filed on Oct. 30, 1979, now U.S. Pat. No. 4,264,999, issued May 5, 1981, and application Ser. No. 166,396, filed on July 7, 1980.

BACKGROUND OF THE INVENTION

1. Field of the Invention

The present invention relates to mechanical devices which are capable of treating flooring surfaces, and it more particularly relates to a device which can be wheeled along on top of a flooring surface, such as a rug positioned over a floor surface or a wooden or tiled floor surface itself, to either clean the surface, remove wax from the surface, or wax and buff the surface, i.e., at the option of the operator.

2. Description of the Prior Art

Mechanical fabric and floor surface spray and cleaning devices are of course well known and are widely used, and such devices are fully shown and described, for example, in U.S. Pat. Nos. 4,127,913; 4,104,067; 4,019,218; 4,023,223; 2,885,713; 3,962,745; 3,992,747 and 4,009,728. However, in all of the known spray cleaning devices the operator has a very active and laborsome function in the operation of the devices, e.g., that of holding the hollow stem of the cleaning wand and manually passing the cleaning head of the wand in separate passes across the surface to be cleaned. The operator may also be required to simultaneously squeeze a trigger attached to the wand so that cleaning liquid will be discharged ahead of a vacuum slit as the cleaning head is moved in the desired direction along the surface to be cleaned (the trigger being released as the cleaning head is returned to a point adjacent its original starting point), or else the operator may be required to squeeze a trigger to alternate discharge of treating solution and then creation of a vacuum in a cleaning head in separate strokes as the cleaning head is sequentially passed over the same area to be cleaned. In any event, much operator work is required and the cleaning process is slow and inefficient since an individual cleaning head must be passed in a separate motion at least one time over each zone of the surface to be cleaned for each individual cleaning operation.

It is an object of the present invention to provide a flooring surface treating device which is much more efficient than the prior art devices, which requires much less operator work input, and which can more thoroughly treat a given zone in a given amount of time than the conventional stroke-type devices.

SUMMARY OF THE INVENTION

The flooring surface treating device of the present invention comprises a rotary mechanism which utilizes a wand that includes multiple radial vacuum ducts and multiple radial treating solution discharge pipes, the wand being mounted for rotary motion over the surface of the flooring to be treated. The operator of the mechanism need only be concerned with the settings for the speed of the wand rotation and the flow of treating solution to the discharge pipes, otherwise the only work required of the operator is to push or pull the mechanism, which is mounted on wheels, in the desired fashion across the surface to be treated. The rotary motion of the wand allows for multiple passes of the vacuum ducts and the discharge pipes over the same portions of the floor surface to be treated per unit of time, thus resulting in enhanced treating with a minimum of operator effort.

The rotary mechanism of the invention specifically comprises a lower carriage unit which includes a shroud, a rotatable wand mounted beneath and within the shroud such that its multiple radially extending arms (each of which includes both an elongated vacuum duct and an attached elongated discharge pipe with spray nozzles) can rotate over the flooring surface, and a drive motor mounted on the shroud so as to rotate the wand. The lower carriage unit is suitably mounted on wheels for easy movement across the flooring surface, and it connects with an upper handle unit which extends upwardly towards the operator to allow the operator to easily control the movement and operation of the lower carriage unit. Thus, the upper handle unit includes a suitable handle bar for the operator to grip, as well as a control box with dials for controlling at least the speed of wand rotation. In one embodiment of the invention the upper handle unit will also mount a treating solution supply tank for the gravity feed of treating solution via a hose to the wand in the lower carriage unit. With this embodiment of the invention, the control box will also include a dial to provide for control of the gravity feed of treating solution out of the supply tank. The wand will also include as an integral part thereof a pan for the temporary storage of treating solution which is supplied thereto as an intermediary stop on its way to each separate discharge pipe (so as to be ultimately sprayed out of the spray nozzles which are located along the length of each discharge pipe).

In an alternative embodiment of the invention the wand will similarly include as an integral part thereof a pan for the temporary storage of treating solution; however, the treating solution will be delivered directly thereto from a remote and separate supply tank, i.e., by means of a flexible hose. In this embodiment the remote and separate supply tank will include a pressure-sensitive supply pump which can be suitably adjusted so as to cause the treating solution to be supplied to the discharge pipes (via the wand pan) at a suitable rate.

In a still further embodiment of the invention the drive motor, which is mounted on the shroud of the lower carriage unit, will utilize a hollowed out drive shaft having an upper end extending upwardly through the drive motor housing, this upper end terminating in a liquid-tight coupling connection, whereas the lower end of the hollow drive shaft will mount the wand and will include multiple openings to which will be connected to multiple short hoses that will each extend to a separate respective discharge pipe. Treating solution which is supplied under a suitable pressure to the upper end of the hollowed out motor drive shaft will thus be delivered downwardly through the drive shaft interior, then through the separate hoses, and ultimately to each of the discharge pipes so as to be sprayed out of the spray nozzles which are located along the length of each discharge pipe, i.e., at the same time that the drive motor rotates the wand.

In a still further embodiment of the invention the wand will be attached to a hollow center shaft which will extend upwardly through the shroud of the lower carriage unit and terminate in a rotatable and liquid-tight coupling connection. The hollow center shaft will also include multiple openings, to each of which will be connected the end of a respective hose, each hose extending to connect at its opposite end to a separate discharge pipe. On the other hand, the drive motor will be separately mounted above the shroud so as to leave a spacing between its downwardly extending drive shaft and the hollow center shaft. Suitable interconnection devices are used to connect the drive shaft of the motor and the hollow center shaft such that rotation of the drive shaft will cause rotation of the hollow center shaft, the relative rates of rotation being adjustable as desired. At the same time, treating solution which is supplied under a suitable pressure to the liquid-tight pressure connection at the upper end of the hollow center shaft will be delivered downwardly through the interior of the hollow center shaft, then through the separate hoses, and ultimately to each of the discharge pipes.

In any of the embodiments of the present invention, a flexible hose will be connected between a vacuum chamber which is formed as part of the shroud of the lower carriage unit (the vacuum chamber being in vacuum communication with the elongated vacuum ducts of the wand) and a separate vacuum generating/dirty solution deposit device, so that a vacuum can be created in the various vacuum ducts of the wand. In this way treating solution sprayed onto the flooring surface from the discharge pipes can then be vacuum removed through the vacuum ducts, the vacuum chamber and the hose, and be ultimately disposed of in an appropriate fashion.

Further features, uses and advantages of the present invention will now be better explained by reference to the accompanying drawings taken in conjunction with the following description.

BRIEF DESCRIPTION OF THE DRAWINGS

In the drawings,

FIG. 1 shows a side view, partially cut away, of a rotary flooring treating device constructed in accordance with one embodiment of the present invention;

FIG. 2 shows a plan view of the flooring treating device shown in FIG. 1;

FIG. 8 shows a cross-sectional view of one of the radial arms of the wand as seen along line 8—8 of FIG. 3;

DETAILED DESCRIPTION OF THE PREFERRED EMBODIMENTS

Figure 3:
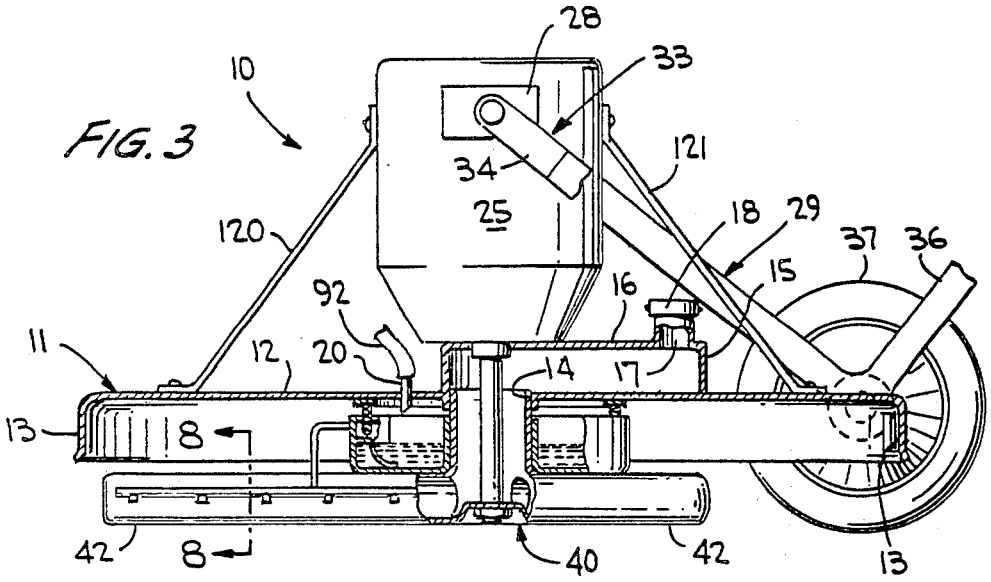
FIG. 3 shows an enlarged side view, partially in section, of the lower carriage unit of the floor treating device shown in FIG. 1.

FIGS. 1–8 depict a preferred form of the rotary flooring treating device as contemplated by the present invention, i.e., they show a rotary spray and vacuum device which can in fact be operated in a number of different ways and on a number of different flooring surfaces. For example, the depicted device could be used to spray a liquid cleaning solution onto the surface of a rug, and then vacuum remove the solution, together with loosened, suspended or dissolved dirt; it could be used to spray a wax-removing solution onto a wooden or tile floor surface, and then vacuum remove the solution mixed with suspended or dissolved wax; it could be used to spray a liquid wax solution onto a wooden or tile floor surface, and then buff the surface, i.e., when auxiliary buffer pads are utilized on the appropriate parts of the device; etc. Among the various Figures, like numerals refer to like elements.

Referring initially to the rotary spray and vacuum device as shown in FIG. 1, it can be seen that the overall appearance of the device resembles that of a rotary electric lawn mower; however, as will be better appreciated from the discussion which follows, the similarities are clearly only superficial.

The device is essentially constructed of two separate yet interconnected structures: a low carriage unit 10 which includes the wheels necessary to allow an operator to move the device across the flooring surface to be treated (such as a rug positioned on the flat and horizontal floor of a house or office, or else wooden or tiled floors in such buildings), and an upper handle unit 80 which, among other things, provides the means by which an operator of the treating device can easily grasp the device and also control its operation and movement.

Viewing first the elements which make up the upper handle unit 80, it is seen to include two spaced apart extension members 81 and 82 which are both rigid and, in the specific configuration of the preferred inventive embodiment shown in FIG. 2, identical in shape, and positioned so as to represent mirror images of one another with respect to a center line (not shown) extending through the treating device. Each of the extension members includes first and second holes through the respective opposite ends, and extending through the aligned first holes of the extension members is a fixedly connected handle bar 83, while extending through the aligned second holes is an elongated connection bar 84. Each extension member is capable of rotating around the connection bar 84, which itself includes an enlarged knob 86 at one end and a wing nut 85 threaded onto the other end. In order that the upper handle unit be adjustable with respect to the lower carriage unit, a number of grooves (not shown) extend in a radial fashion around the second holes in each of the extension members so as to be capable of lockingly interconnecting with similar grooves on adjacent and contacting bracket members of the lower carriage unit. In this regard, and in the embodiment shown in FIG. 2, the noted grooves will be located on the sides of the extension members which face away from one another such that they can each interlock with similar grooves located around the aligned holes (through which the connection bar 84 also extends) on facing sides of bracket members 29 and 33 which extend upwardly from the lower carriage unit 10. Once the rotational placement of the extension members with respect to connection bar 84 has been achieved, such that the desired angular orientation of the upper handle unit 80 has been determined with respect to the lower carriage unit, the wing nut 85 it tightened. Thus, the height of handle bar 83 from the flooring surface can be easily tailored to the height of the treating device operator.

The handle bar 83 is fixedly connected to the extension members, e.g., by welding. In addition, a control box 94 is mounted on the handle bar 83 which includes suitable means to allow the operator to control the operator of the treating device (as will be discussed in more detail hereinafter).

A hollow tank 87, which is depicted as having a cylindrically-shaped side wall with top and bottom surfaces 88 and 89, is supportingly mounted (e.g. by welding) between the extension members 81 and 82. This tank, which is used to hold the desired treating solution, includes an upper filling port in top surface 88, which can be closed in a suitable fashion by a vented cap 90, and a lower discharge port in bottom surface 89, which includes therein an adjustable valve 91. A flexible delivery hose 92 is at one end sealingly attached in a suitable fashion to the adjustable valve 91 and at its other end to the lower carriage unit for gravity feed of treating solution from tank 87 when the valve 91 is opened. The upper filling port is preferably located in top surface 88 at a point distant from each of extension members 81 and 82, whereas the lower discharge port is preferably provided in the bottom surface 89 at a point near the extension members 81 and 82. These locations optimize the ease and function of adding and removing treating solution from the tank. The adjustable valve 91 is connected via a cable 100 to control box 94 for control thereof as will be discussed more fully below.

Viewing now the features which comprise the lower carriage unit 10, it is seen to include as essential elements, shroud 11 (see FIG. 3), drive motor 25, and a wand 40. The shroud 11 includes a generally disc-shaped cover part 12 having a centrally-located opening 14, and a continuous downwardly extending side skirt 13 at the periphery thereof. In addition, extending upwardly from the upperside of cover part 12 and so as to enclose opening 14 are side walls 15 which merge with an interconnecting top wall 16 to form a generally radially-extending vacuum chamber. At the end of top wall 16 opposite the opening 14 is a vacuum intake port 17 which includes a hose connector 18. One end of a flexible vacuum hose 110 is sealingly connected to the hose connector 18, while the other end of the hose is connectable to a separate device (not shown) which not only creates a vacuum in hose 110, but also includes a deposit tank for receiving the dirty treating solution which is vacuumed up by the wand of the inventive device and is sucked through hose 110. Separate devices of this type are well known in the art and will not be further discussed herein.

Extending downwardly from the underside of the cover part 12 and so as to enclose the opening 14 in an annular vacuum seal means 19 which includes an inner surface capable of providing a generally vacuum-tight connection with an upper cylindrical portion 41 of the wand 40, yet allow for free rotational movement of the wand with respect thereto.

Shroud 11 also includes a gravity discharge pipe 20 which extends generally downwardly through the cover part 12. The upper end of the pipe 20 is capable of sealingly interconnecting with the lower end of the mentioned flexible delivery hose 92, whereas the lower end is positioned to discharge the gravity-fed treating solution to a doughnut-shaped pan 51 of the wand 40 when the wand is appropriately connected to be positioned therebelow.

Mounting members 120 and 121 fixedly mount the shroud 11 to the sides of a drive motor 25, which in this depicted embodiment of the invention, is a reversible, variable-speed electric motor (operable, for example, on normal 117-volt AC current). The motor includes a drive shaft 26 (see FIG. 5) which extends in sealing fashion through the top wall 16 of the shroud vacuum chamber and centrally through the opening 14. Two mounting brackets 27 and 28 are provided on opposite sides of the motor 25 (see FIGS. 2 and 3), to which are attached (via suitable connection means) the ends of respective bracket members 29 and 33. These bracket members each have a generally V-shaped form and are composed of downwardly extending motormount portions 30 and 34, downwardly and outwardly extending intermediate portions 31 and 35, and upwardly extending connection bar mounting portions 32 and 36. Wheels 37 and 33 are mounted on the respective bracket members in suitable fashion to movably support the bracket members, and thus the entire treating device, for movement on and over the flooring surface to be treated. As discussed previously, the upwardly extending connection bar mounting portions 32 and 36 include aligned holes therein for extension therethrough of the connection bar 84, as well as radially-extending grooves therearound (not shown) on their facing sides for interconnection with similar cooperating grooves on extension members 81 and 82.

The structural dimension of shroud 11 and the structural lengths of bracket members 29 and 33, as well as the location of mounting brackets 27 and 28 on motor 25 are coordinated such that the wheels 37 and 38 will extend to a point below the lowermost extent of shroud side skirt 13.

Figure 5:
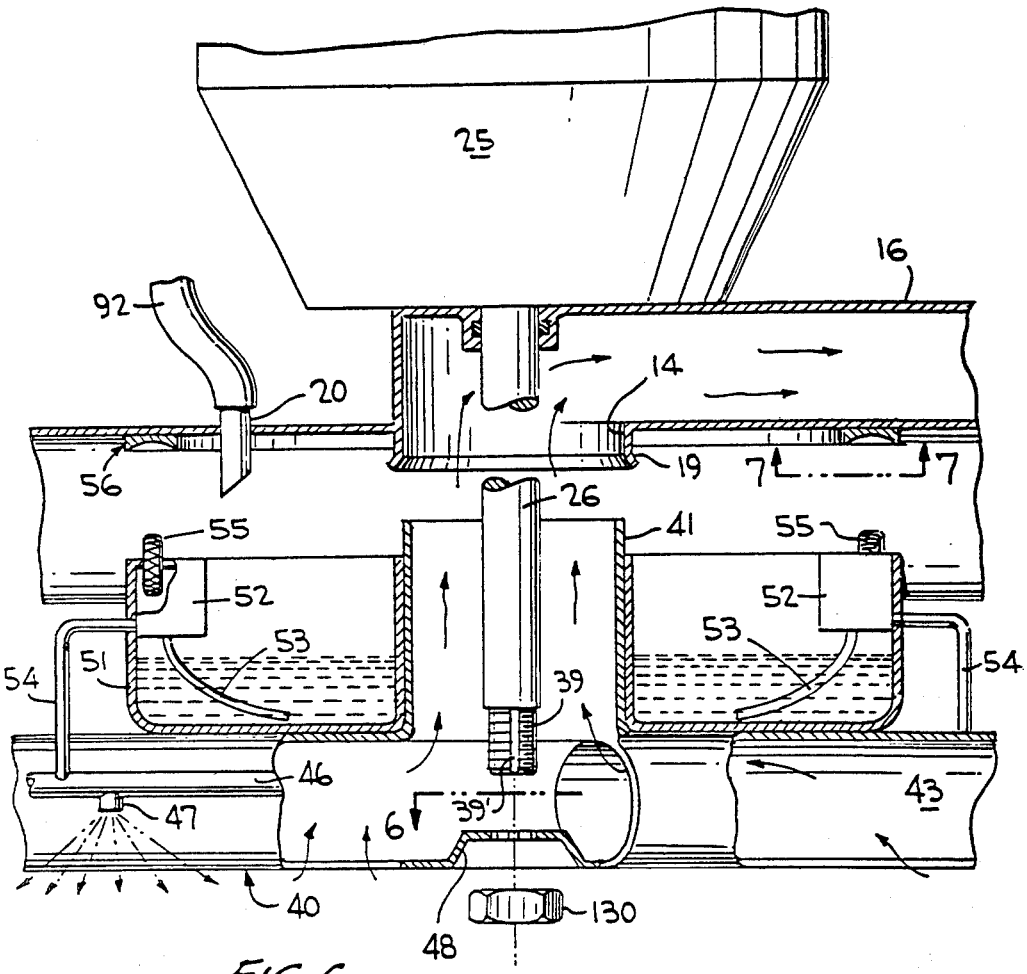
FIG. 5 shows on an even larger scale an exploded partial side view, partially in section, of the drive motor, the shroud and the wand of the lower carriage unit.

As can be seen from FIG. 5, the lowermost portion of drive shaft 26 is provided with threads 39, as well as four spaced apart slots 39'. A cooperating locking nut 130 is threadingly engageable onto the end of drive shaft 26 to attach the wand 40 to the drive shaft 26.

Referring now to FIGS. 3, 4, 5 and 8, the wand 40 of the invention comprises a generally cylindrical hollow portion 41 which, at its bottom, merges with a number of radially extending identical arms 42. Each arm includes an elongated vacuum duct 43 which is in fluid communication with the hollow area within portion 42, and a fluid discharge pipe 46 attached to one side of the ducts by suitable spaced apart means 45. The vacuum ducts, which are seen in FIG. 8 to advantageously have generally pear-shaped cross-sections as well as elongated vacuum slots 44 at the underside thereof, extend radially within the shroud 11 to a point just inside of skirt 13, such that the arms of the wand will be freely rotatable within shroud 11. Each fluid discharge pipe 46 includes a number of spaced apart spray nozzles 47 for spraying the treating solution onto the surface of the flooring being treated.

Figure 6:
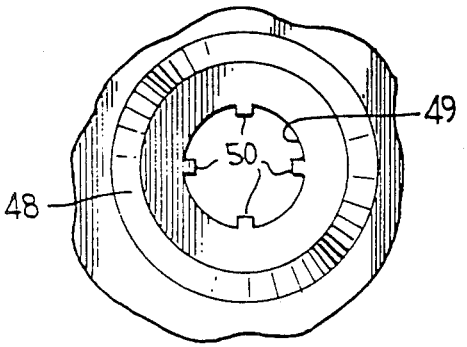
FIG. 6 shows a top view of the bottom central portion of the wand as seen from line 6—6 of FIG. 5.

On the underside of the lowermost central part of the wand 40 where the arms 42 merge is located an indented portion 48 which includes in the floor portion thereof a generally circular opening 49 that is interrupted with four circumferentially spaced apart, radially inwardly extending protrusions 50 (see FIG. 6). The size of the opening 49 corresponds with the diameter of drive shaft 26 and the sizes and positionings of protrusions 50 correspond with the sizes and positionings of slots 39', such that the wand can be slid upwardly (as suggested in FIG. 5) and be fixedly interconnected with drive shaft 26, both longitudinally and rotationally, by threading nut 130 on threads 19, i.e., after the wand has been positioned around drive shaft 26, and after the protrusions 50 have been positioned within (and rotationally locked by) slots 39'. The length and diameter of the generally hollow portion 41 of wand 40 will be such that when wand 40 is fully and appropriately attached to drive shaft 26, the top part of portion 41 will fit within annular vacuum seal means 19 such that a good vacuum seal therebetween is obtained, yet rotatability of the wand with respect to the shroud will also be retained (such connections of this type are conventional and will not be further discussed herein).

Figure 7:
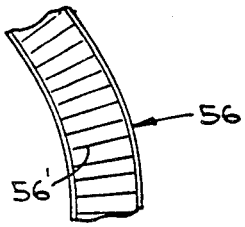
FIG. 7 represents a partial view of the annular friction track which is located on the underside of the cover part of the shroud as seen from line 7—7 of FIG. 5.

Positioned around the outer surface of the generally hollow portion 41 of wand 40 and so as to be located on top of the inner portions of radially extending arms 43 is a doughnut-shaped pan 51 which functions to contain treating solution delivered thereto from pipe 20. The pan 51 is connected to and rotatable with the hollow portion 41 and arms 42. Mounted in the upper corner of the pan as shown in FIG. 5 are a number of pumps 52 which are capable of supplying treating fluid from within the pan 51 to each of the discharge pipes 46. A separate pump will be positioned within pan 51 so as to feed treating solution to an adjacent discharge pipe therebelow. Each pump includes a suction hose 53 which extends to the bottom of the pan 51, a delivery conduit 54 for delivering solution to the respective discharge pipe 46, and a friction wheel 55 which powers the pump. In this regard, when the wand is properly connected to the drive shaft 26 such that it is in its operative position within shroud 11, the friction wheels 55 of all the pumps will contact an annular friction track 56 positioned on the underside of the cover part 12 (see FIG. 5) so as to be rotated (thus powering the pumps) as the motor 25, via drive shaft 26, rotates wand 40 within shroud 11. As shown in FIG. 7, the friction track 56 advantageously includes a serrated surface 56'.

A window 57 may be provided in cover part 12 (see FIG. 2) to allow the operator of the device to determine whether or not too much treating solution is contained in pan 51, such that suitable adjustments to the opening of adjustable valve 91 via use of control box 94, if needed, can be made.

Returning now to the use and function of control box 94, this device first of all includes an on-off selector dial which, via power line 95, allows the operator to turn the motor on, and then determine not only the direction of rotation of drive shaft 26, but also select its speed of rotation (e.g. provide for three or four different speeds). In addition, control box 94 includes a gravity feed control dial which allows the operator to control the setting of adjustable valve 91 (via cable 100) and thus the amount of treating solution fed by gravity through flexible hose 92 such that pan 51 of wand 40 retains a steady-state amount of treating solution, e.g., when the wand is rotating and pumps 52 are pumping treating solution from pan 51 to discharge pipes 46 and out spray nozzles 47. Adjustments can be made not only for the speed of wand rotation, and thus the amount of treating solution pumped by pumps 52, but also based on the exact number of arms the particular wand may have. Of course, in the embodiment of the invention depicted in the present drawings, the wand includes only three arms.

The operation of the described embodiment of the inventive treating device is thus generally as follows (assuming it is in assembled condition and the control dials in control unit 94 are set at "off" or "zero"): first, the desired treating solution is poured into tank 87 by removal and then replacement of vented cap 90 in the upper filling port of the tank 87. Then the electrical line extending from control unit 94 is connected into a standard wall outlet. Thereafter the flexible vacuum hose 110 is connected at one end to hose connector 18 and its other end to a (separate) combination vacuum generating/dirty solution storage device, and this device is activated so as to create a vacuum in hose 110. This concurrently creates a vacuum in the shroud vacuum chamber, the hollow portion 41 of wand 40, and in all of vacuum ducts 43. Thereafter, the appropriate dial on the control box 94 is adjusted so that electric motor 25 causes drive shaft 26 to rotate wand 40 in the desired direction and at the desired rotational speed, and then the dial which controls adjustable valve 91 is appropriately adjusted so that the desired rate of delivery of treating solution through hose 92 to pan 51, and thus ultimately to discharge pipes 46 and spray nozzles 47 will occur.

Figure 4:
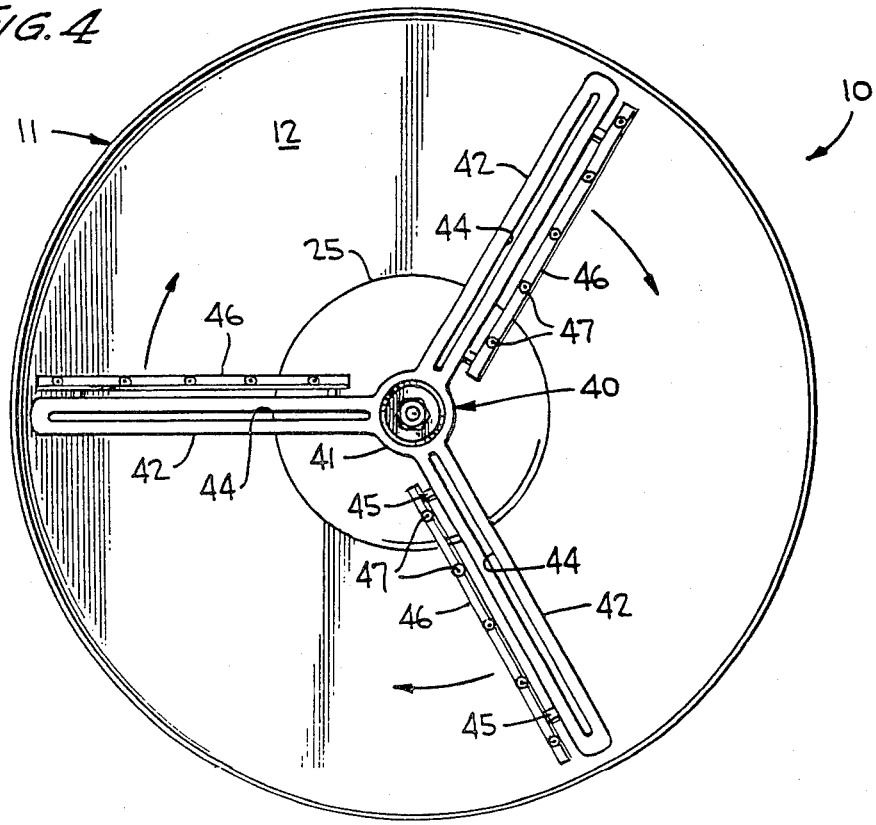
FIG. 4 shows on the same scale as FIG. 3 a bottom view of the shroud and wand which comprise essential parts of the lower carriage unit of the flooring treating device.

When cleaning a rug, the treating solutions will be a suitable liquid rug-cleaning mixture and the electric motor will be operated such that the wand rotates as shown by the arrows in FIG. 4, i.e., so that the cleaning solution will be sprayed into the rug and shortly thereafter vacuumed up and away, first through the slots 39' in vacuum ducts 39, then through cylindrical hollow portion 41, opening 14, the shroud vacuum chamber, port 17, hose 110, and finally to the deposit tank of the vacuum generating/dirty solution storage device. The sweeping action of the rotating wand arms will prevent the arms from being retained in any way in the surface to be cleaned, i.e., in the pile of a thick rug.

Although the foregoing description details a specific embodiment of the treating device of the present invention, the apparatus can be different in many ways and still be within the scope of the present invention.

Figure 9:
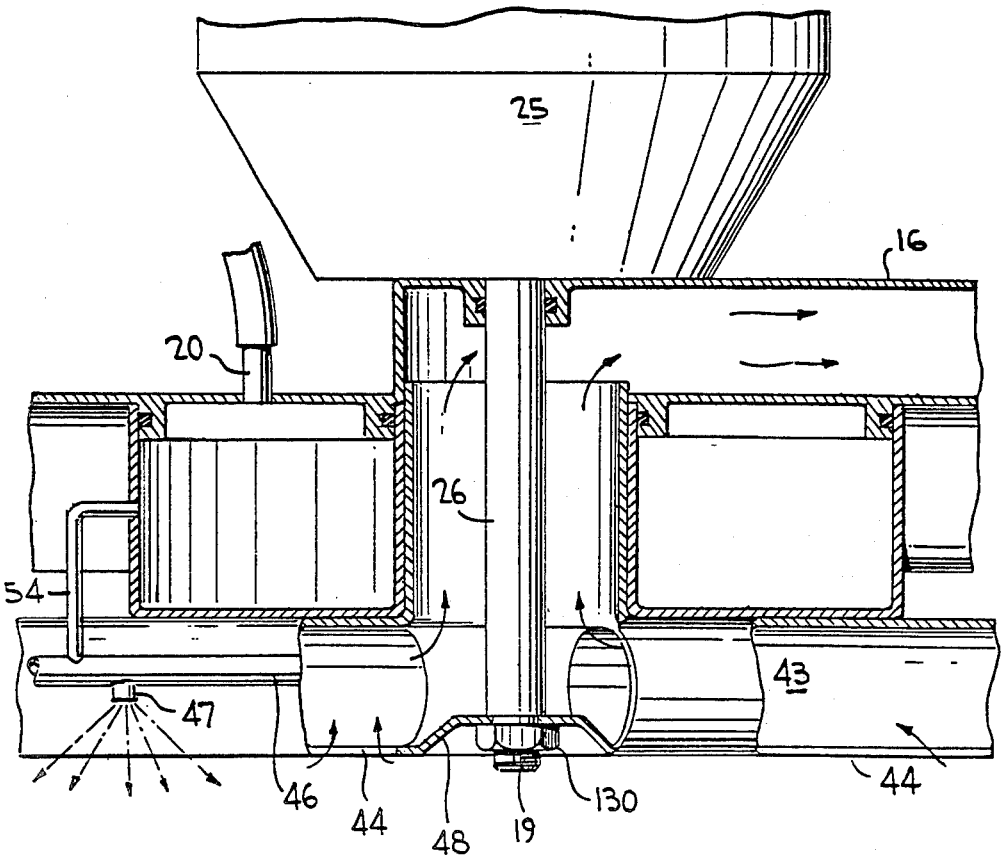
FIG. 9 shows a partial side view, partially cut away, of an alternative embodiment of rotary floor treating device which utilizes a modified wand structure and cooperating shroud cover part.

In another embodiment of the invention, the flooring surface treating device can be constructed without a treating solution supply tank 87, and the upper end of the flexible hose 92 can, instead of being connected to a supply tank 87, be connected to a separate and remote supply tank which will include a pressure-sensitive supply pump for supplying treating solution through the hose 92 and pipe 20 to wand pan 51. In this embodiment, which is represented in FIG. 9, the pumps 52 and the suction hoses 53 in wand 40 are omitted, and the annular friction track 56 positioned on the underside of the cover part 12 is replaced with an annular bearing seal means 60 which can form a liquid-tight seal with the upper, outer rim 61 of the pan 51, yet allow for the pan 51 to slide therealong as the wand 40 rotates within the shroud 11. The annular bearing seal means 60 will be positioned radially outwardly of both the opening 14 in the cover part 12 and the annular vacuum seal means 19. The treating solution supplied under pressure from the remote and separate supply tank (not shown) through flexible hose 92 will pass through pipe 20 into pan 51 so as to entirely fill the pan and become pressurized, and the thus pressurized treating solution will then pass through delivery conduits 54 to delivery pipes 46 and out nozzles 47. The pressure-sensitive supply pump of the remote and separate supply tank can be suitably adjusted so as to cause the treating solution to be supplied at such a rate that the desired amount of treating solution will be sprayed out of nozzles 47.

Figure 10:
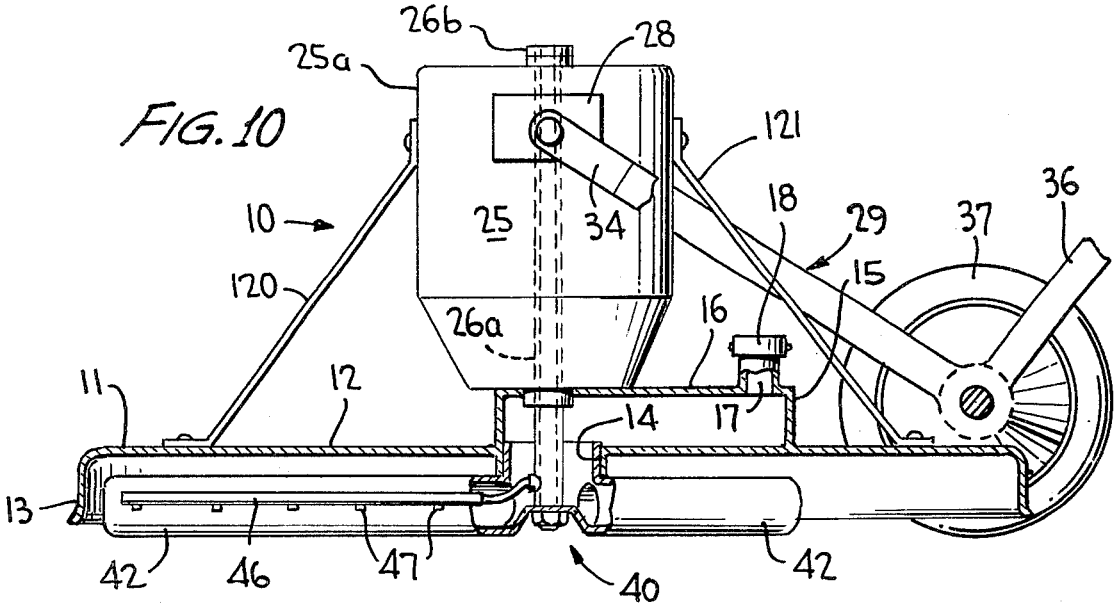
FIG. 10 shows an enlarged side view, partially in section, of the lower carriage unit of a further embodiment of floor treating device according to the present invention.
Figure 11:
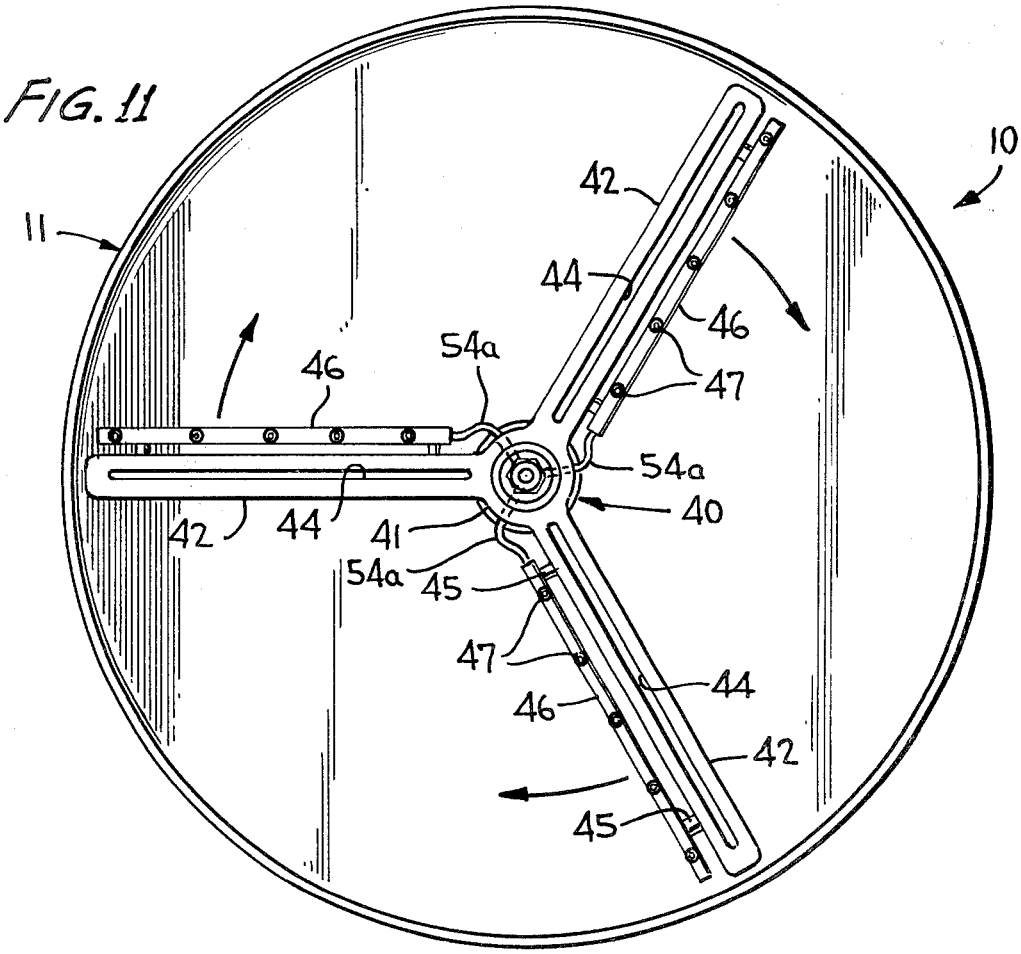
FIG. 11 shows on the same scale as FIG. 10 a bottom view of the shroud and wand which comprise essential parts of the lower carriage unit shown in FIG. 10.

In a further embodiment of the invention the flooring surface treating device can be constructed without a treating solution supply tank, and indeed the wand 40 in the lower carriage unit need not include a wand pan 51. Neither will the feed pipe 20 need to be connected through a hole in the shroud cover part 12. Instead, as shown in FIG. 10 the drive motor 25 of the lower carriage unit 10 is constructed using a hollowed out drive shaft 26*a*, the upper end of which extends through the top of the casing 25*a* of motor 25. To the upper end of the hollowed out drive shaft is attached a liquid-tight rotatable coupling element 26*b*. The lower end of the hollowed out drive shaft includes multiple openings (which will be located above the lowermost portion of the drive shaft, i.e., the portion around which threads 39 are located and which is solid in construction), and suitably sealingly connected to each opening is one end of a hose 54*b*, the other end of each hose being sealingly connected to the end of an associated discharge pipe 46. In a typical treating device as shown in FIG. 11 wherein the wand 40 will include three arms 42 (and thus three discharge pipes 46), the lower end of the hollowed out drive shaft includes three openings which are equally spaced apart around the circumference of the hollowed out drive shaft 26*a*, and each opening has a hose 54*b* connecting the opening with a separate discharge pipe 46. In this particular embodiment of the invention a flexible hose (which will have a pressure coupling fitting on one end capable of interconnecting with the rotatable coupling element 26*b* on the upper end of hollowed out drive shaft 26, whereas the other end will be connected to a remote and separate treating solution supply tank) will be connected to the coupling element 26*b*, and after suitably adjusting the pressure-sensitive supply pump on the remote and separate supply tank, treating solution will be fed to the top of the hollowed out drive shaft 26*a*. This treating solution will then pass downwardly through the drive shaft, through the openings in the lower end thereof, through the separate hoses 54*a* and finally into the separate delivery pipes 46, whereafter the treating solution will be sprayed onto the flooring at the desired rate via spray nozzles 47.

Figure 12:
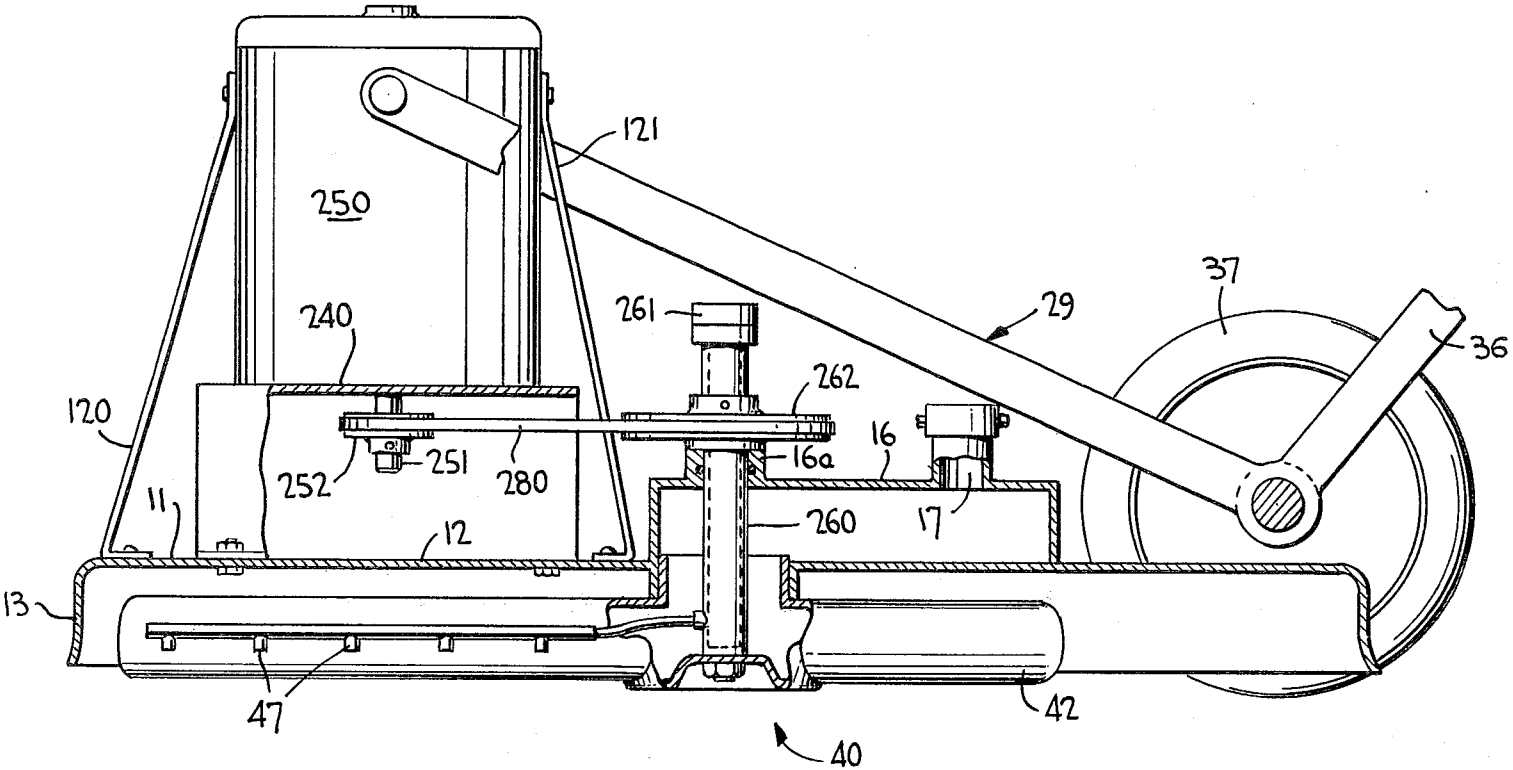
FIG. 12 shows an enlarged side view, partially cut away, of a still further embodiment of floor treating device according to the present invention.

In FIG. 12 a still further embodiment of the invention is shown, this embodiment representing a variation of the previous embodiment shown in FIGS. 10 and 11. It can be seen that the wand 40 is attached to the lowermost end of a hollow center shaft 260, this hollow center shaft extending upwardly through the top wall 16 of the radially-extending vacuum chamber of the shroud via a pressure-tight seal 16*a*. The hollow center shaft will be freely rotatable with respect to the pressure-tight seal 16*a*. The uppermost end of the hollow center shaft terminates with a rotatable liquid-tight coupling member 261, this member 261 being removable when necessary from attachment to the hollow center shaft. Similarly to the situation with hollowed out drive shaft 26*a* in FIG. 10, the hollow center shaft 260 also includes openings located above its lowermost portion (which is itself solid in construction and externally threaded to provide connection to wand 40), and suitably sealingly connected between each opening and an associated discharge pipe 46 is a short hose 54*b*.

A sprocket 262 is attached to the hollow center shaft 260 at a point between the top wall 16 and the rotatable liquid-tight coupling 261, the sprocket 262 being removable from the shaft 260 (when the coupling 261 is also removed) and replaceable with a different sprocket having a different diameter.

The drive motor 250 is, on the other hand, mounted on the shroud 11 by a suitable support 240 so as to be spaced from the hollow center shaft 260, the drive shaft 251 extending downwardly as shown. A sprocket 252 is removably mounted on the drive shaft 251 so as to be in alignment with the sprocket 262. An endless driver element 280, preferably an endless link chain, is mounted between and around the sprockets 252 and 262 such that rotation of the drive shaft 251 will cause rotation of the hollow center shaft 260 (and thus wand 40). Appropriate selection of the diameters of the sprockets 252 and 262 will allow for control of the relative speeds of rotation between the drive shaft 251 and the wand 40. The wand 40 will rotate while treating solution, supplied to the rotatable liquid-tight coupling member 261 from a flexible hose, passes downwardly through the hollow center shaft, through the hoses 54*b*, and out the spray nozzles 47 on the discharge pipes 46.

Of course, the sprockets 252 and 262 and the interconnecting endless driver element 280 could be replaced with other mechanisms for interconnecting the drive shaft 251 with the hollow center shaft 260 and concurrently provide for adjustments in the relative rotations thereof, e.g., such as interconnecting and shiftable gears in a transmission box.

Even with the embodiment of the invention depicted in FIGS. 1–8, the particular configurations and interconnections of the various elements can be different, as long as they retain their functionality. For example, the extension members 81 and 82 may have any suitable shape as long as they can support tank 87 and both appropriately mount a handle bar 83 (and control box 94) and interconnect with bracket members 29 and 33; the same applies for the bracket members in their interconnecting function between shroud 11, wheels 37 and 38, and extension members 81 and 82; the same applies to the type and placement of pumps 52 in the wand pan 51. In this latter regard, it may be quite advantageous to place suction hoses 53 of pumps 52 along the external side of pan 51, yet have a mouth opening in the bottom of the pan so as to suck treating liquid therein, i.e., so as to eliminate any turbulence created that would be created in the treating solution contained in pan 51 as the wand is rotating. At the same time, the pump itself could be any suitable type, e.g., an impeller pump, a displacement pump, etc.

In another advantageous construction of the invention (which can apply to any of the aforementioned embodiments), before use of the treating device the vacuum ducts 43 of wand 40 can be externally covered by the operator with separate buffer cloths (not shown), such that when the treating solution used in the treating device (and thus sprayed out of spray nozzles 47 onto the flooring surface) is a wax solution, the ducts 43 can act as buffer means.

Thus, it is clear that numerous modifications in the above-described embodiment of the invention are possible and still be within the scope of the appended claims.

I claim:

1. A rotary flooring surface treating device which is movable on and over the surface to be treated, said device comprising a lower carriage unit and an upper handle unit, said lower carriage unit including a shroud means, a wand means, a hollow center shaft, a drive means and an interconnection mechanism, said shroud means including a generally disc-shaped cover part having a skirt extending downwardly from the periphery thereof and an opening therethrough at the center thereof, said shroud means also including means forming a vacuum chamber positioned on the upperside of said cover part so as to enclose said opening, said vacuum chamber including means forming a port for sealing attachment thereto of one end of a flexible hose which is connectable at its other end to a remotely positioned vacuum generating means, said shroud means also including an annular vacuum seal means extending downwardly from the underside thereof so as to enclose said opening, said seal means being capable of forming a substantially vacuum-tight seal with an upper part of a hollow cylindrical portion of a wand means positioned therein, yet allow for free rotation of said upper part therein;

said wand means including a hollow cylindrical portion whose upper part is generally sealingly yet rotationally mounted within said annular vacuum seal means and multiple radially-extending arms, said arms each including a radially-extending vacuum duct means with a bottom vacuum slot, each of said vacuum duct means being operatively connected to the lower part of said hollow cylindrical portion, and a discharge pipe with spray nozzles attached to the side of each vacuum duct means;

said hollow center shaft extending from below said shroud means upwardly through said vacuum chamber and above said shroud means, the lowermost end of the hollow center shaft mounting said wand so as to rotate same and the uppermost end of said hollow center shaft connecting with a removable, rotatable liquid-tight coupling means, said drive means being mounted on said shroud means such that the downwardly extending drive shaft thereof will be spaced from said hollow center shaft, said interconnecting mechanism connecting the drive shaft of said drive means to the hollow center shaft such that rotation of the former will cause rotation of the latter, multiple hose means sealingly connected to separately extend between one opening in the lower end of said hollow center shaft and a separate discharge pipe, each of said hose means acting to deliver a portion of the treating solution which has passed downwardly through the hollow center shaft from the liquid-tight coupling means to a separate discharge pipe;

said lower carriage unit also including wheel means for movably mounting said shroud means and said wand means above the flooring surface to be treated and a bracket means for connecting said lower carriage unit to said upper handle unit;

said upper handle unit including an extension means and a handle means, said extension means including at least one elongated extension member, one end of which is adjustably connected to said bracket means, said handle means comprising an operator gripper means connected to said extension means adjacent the second end thereof.

2. The rotary flooring surface treating device of claim 1 wherein said interconnecting mechanism comprises a first sprocket means removably attached to said hollow center shaft, a second removable sprocket means removably attached to the drive shaft of said drive means, and an endless driver element connected between and around said first and second sprocket means.

3. The rotary flooring surface treating device of claim 2 wherein said endless driver element comprises a link chain.

4. The rotary flooring surface treating device of claim 1 wherein said bracket means of said lower carriage unit comprises two spaced apart generally V-shaped bracket members, one end of each said bracket member being connected to said drive motor and the other end being connected to said extension means of said upper handle unit, each said bracket member also mounting a separate said wheel means.

5. The rotary flooring surface treating device of claim 4 wherein said extension means of said upper handle unit comprises two spaced apart extension members, wherein said handle means is connected between the ends of said extension members remote from said lower carriage unit, and wherein the opposite ends of said extension members are adjustably connected with respective said other ends of said bracket members.

6. The rotary flooring surface treating device of claim 5 wherein said opposite ends of said extension members includes aligned holes therethrough, wherein said other ends of said bracket members includes aligned holes therethrough, wherein a connection bar having an enlarged portion at one end and a threadably engageable wing nut at the opposite end extends through all said aligned holes, and wherein radial grooves extend outwardly of said aligned holes such that by operation of said wing nut the angular orientation of said extension members and thus said upper handle unit, can be adjustably changed with respect to bracket members, and thus said lower carriage unit, as desired.

7. The rotary flooring surface treating device of claim 1 wherein said upper handle unit includes a control box, said control box being operatively connected to said drive motor to help control the rotational speed at which said hollow center shaft is rotated.

8. The rotary flooring surface treating device of claim 1 wherein each said vacuum duct means of said wand means has a generally pear-shaped cross-section, and wherein each vacuum slot comprises a slit means at the bottom of each vacuum duct means of generally pear-shaped cross-section to allow vacuum removal of dirty treating solution from the treated flooring surface.

9. The rotary flooring surface treating device of claim 1 wherein the lowermost part of said hollow shaft includes a solid portion having threads therearound and slots therein, wherein said wand means includes a hole therethrough at the bottom center thereof with radially inwardly extending protrusions, wherein said hollow center shaft fits through said hole in said wand means and said protrusions fit within said slots, and wherein a lock nut is threaded onto the threads of said hollow center shaft to longitudinally and rotatably connect said wand means to said hollow center shaft.

10. The rotary flooring surface treating device of claim 1 wherein said wand means includes three equally spaced-apart arms.

* * * * *